US005820304A

United States Patent [19]

Sorheim et al.

[11] Patent Number: 5,820,304

[45] Date of Patent: Oct. 13, 1998

[54] BLOCKS FOR CONSTRUCTING RETAINING WALLS

[75] Inventors: Daniel Sorheim, Medford; Michael Smuda, Farmington, both of Minn.

[73] Assignee: Custom Precast & Masonry, Inc., Faribault, Minn.

[21] Appl. No.: 791,751

[22] Filed: Jan. 29, 1997

[51] Int. Cl.[6] ..... E02D 29/02

[52] U.S. Cl. ..... 405/286; 405/262; 405/284; 52/604; 52/605

[58] Field of Search ..... 405/284, 285, 405/286, 262; 52/608, 604, 603, 611, 605, 606

*Primary Examiner*—Dennis L. Taylor
*Attorney, Agent, or Firm*—Moore & Hansen

[57] ABSTRACT

The invention comprises a set of two composite masonry blocks, a wall block and an anchor block to construct retaining walls. The wall block is generally trapezoidal in shape and has: a decorative front face opposite and generally parallel to a rear face which defines a key way. The wall block has a top surface which is opposite and generally parallel to a bottom surface. The wall block has side faces which are not parallel so that the width of the rear face is shorter than the width of the front face. An alignment and locking ledge projects downward from the bottom surface and extends across the rear face. The anchor block comprises a first end plate which is opposite and generally parallel to a second end plate. Two parallel side plates extend between and are perpendicular to the first and second end plates. The side plates and the first and second end plates define a central passage. The first end plate further defines a key which is complementary in shape to the wall block key slot and the second end plate defines a key slot which is complementary in shape to the key. The anchor block is shorter in height than the wall block and the anchor block key is shorter in height than the wall block key way. Further, the anchor block may include a central plate, located between and positioned generally parallel to the end plates, extends between and is generally perpendicular to the side plates.

6 Claims, 3 Drawing Sheets

BLOCKS FOR CONSTRUCTING RETAINING WALLS

The present invention relates to a set of blocks and the method of using the set of blocks to build retaining walls and more particularly, to a set of blocks and a method for building retaining walls of intermediate height safely, efficiently and inexpensively.

BACKGROUND

Retaining walls have long been used to prevent berms, slopes and embankments from sliding and slumping and to control soil erosion. Retaining walls have been used not only to support naturally occurring slopes and embankments but to support artificially constructed slopes, embankments, planters, stairways, stream banks and similar earthworks. Composite masonry blocks have proven to be a particularly useful and versatile material for constructing retaining walls.

A number of complex, and expensive, retaining wall systems have been developed for building tall retaining walls, i.e. those over 12 feet in height. The construction of such tall retaining walls typically involves soil studies and professional engineering support. In typical conditions, retaining walls up to approximately 40 inches in height may be constructed from composite masonry blocks of reasonable size and the composite masonry blocks alone are sufficient to prevent sliding and slumping. These short walls generally are designed and built by contractors and home owners and do not require either soil studies or professional engineering support.

However, many applications, including residential, typically require retaining walls taller than 40 inches but shorter than 12 feet in height. Generally speaking, composite masonry blocks of reasonable size alone are not sufficient for constructing such retaining walls and some method of holding the composite masonry blocks in position is also required. Further, such applications demand a practical, cost efficient method of construction which does not require soil studies and professional engineering support.

A three-block system which uses wall blocks mechanically connected to and anchored by a trunk block and a tail block is shown in U.S. Pat. No. 5,350,256 to Hammer. In that system, each of the wall blocks in each course of wall blocks is connected to a trunk block which is in turn mechanically connected to a tail block. The combination of the trunk block and the tail block serves to anchor the wall block. The relative sizes of the blocks used in that system are such that the weights of the trunk block and the tail block are each nearly as great as the weight of the wall block. The number of trunk and tail blocks required by that system, and the labor necessary to lay that number of blocks drive up the cost of constructing such a retaining wall. Accordingly, a more cost effective system is needed for cost sensitive projects such as residential retaining wall construction.

Systems of wall blocks which rely upon a mechanical connection between wall blocks in adjacent courses are shown in U.S. Pat. No. 5,294,216 to Sievert, and U.S. Pat. No. 5,505,034 to Dueck. Such systems rely upon the weight of the wall blocks and are not sufficient for building retaining walls of intermediate height.

A method of anchoring wall blocks with a lattice-like grid connected to the wall blocks is shown in U.S. Pat. No. 5,511,910 to Scales. Such grids and the wall blocks are constructed of dissimilar materials and produced by different manufacturing processes. Building retaining walls according to such a method requires costly excavation and back filling to a distance of perhaps ⅔ the height of the retaining wall. Further, such a method usually requires site specific engineering analysis and design resulting in increased expense. Accordingly, such methods are too expensive for cost sensitive applications such as residential applications.

Therefore there has been a need for a retaining wall system which: (a) utilizes composite masonry wall blocks of reasonable size and weight; (b) provides a cost effective method of anchoring the wall blocks; (c) uses similar materials which can be economically produced by a single manufacturing process; and (d) can be built to heights of at least twelve feet under ordinary climate and soil conditions without requiring expensive soil studies or site specific professional engineering support.

SUMMARY

The present invention comprises a set of two types of blocks, a wall block and an anchor block, having an open central passage, which is shorter and substantially lighter than the wall block. The wall block is generally trapezoidal in shape with a decorative front face generally parallel to and opposite a rear face. The rear face defines a key way which opens at the bottom of the wall block. A spacing and locking ledge projects downwardly from the rear face of the wall block and extends across, and generally parallel to the plane of the rear face.

The anchor block is generally rectangular in shape with a central passage which extends through the anchor block from top to bottom and which is defined by opposite end plates joined by opposite side walls. One end plate defines a key and the opposite end plate defines a key slot which conforms in size and shape to the key. Further, the key generally conforms, in size and shape to the wall block key way, but the height of the anchor block key is shorter than the height of the wall block key way.

A retaining wall of intermediate height may be constructed according to the present invention by first preparing the site to receive the retaining wall. The preparation is site specific but generally includes leveling and filling the site and installing drainage means. A course of wall blocks is then laid to conform to the desired path of the wall. As each wall block in the first course is laid, an anchor block is also laid so that the key of the anchor block is inserted into the key way of the wall block and the anchor block extends away from and perpendicular to the rear face of the wall block. The key of a second anchor block may then be inserted into the key slot of the first anchor block so that the anchor blocks are aligned end to end and extend away from and perpendicular to the rear face of the wall block. Generally speaking, retaining walls up to twelve feet in height will not require the use of more than two, or perhaps three, anchor blocks per wall block in the first course.

A second course of wall blocks is then laid on top of the first course of wall blocks in overlapping fashion, i.e. the center of each wall block in the second course is placed over the adjacent edges of two adjacent wall blocks in the first course. Each block in the second course is pushed forward until the spacing and locking ledge of the wall block touches the rear face of each of the two wall blocks in the first course which are situated directly below. The area behind the two courses is then back filled and compacted. Additional pairs of courses are then laid, back filled and compacted until the retaining wall attains the desired height. Anchor blocks are not required for the top course and the higher pairs of courses will not require the use of two anchor blocks per wall block as may be required in the first pair of courses.

Constructing a retaining wall according to the present invention provides the following advantages. First, the spacing and locking ledge holds the wall blocks of alternate courses in place. Therefore, anchor blocks are not required for alternate courses and substantial cost savings are realized over prior methods. Further back filling and compacting is not required after each course is completed. This also results in a considerable savings in labor and material.

Second, all of the wall blocks and anchor blocks needed to construct the retaining wall may be manufactured in a concrete block plant using well known processes and readily available production machinery. This gives a single concrete block manufacturer control over the quality of all material used to construct a retaining wall. Further, the blocks are made of similar materials and will therefore have similar, well known, properties and characteristics. Therefore, the properties and characteristics of retaining walls constructed from the wall blocks and anchor blocks according to the present invention can be readily determined using generally accepted engineering practices. This will enable the concrete block manufacturer to prescribe general guidelines which, if followed, will permit masonry contractors and homeowners to design and construct retaining walls of up to twelve feet in height under normal climate and soil conditions without professional engineering assistance.

Third, the wall blocks may be made of reasonable size and weight, i.e. under 70 lb. This reduces the chance of injury to the persons building the wall due to the repeated lifting of heavy blocks and provides a system of blocks which may be installed by homeowners.

Fourth, because the key way extends only part way through the wall block and the key of the anchor block is shorter than height of the key way, the hazard of pinching injuries to the persons laying the block is substantially reduced.

DRAWINGS

These and other features, aspects and advantages of the present invention will become better understood with regard to the following description, appended claims, and accompanying drawings where:

DESCRIPTION OF THE INVENTION

The invention comprises a set of two distinct composite, masonry blocks for constructing a retaining wall and a method of constructing a retaining wall using these blocks as construction elements.

Figure 1:
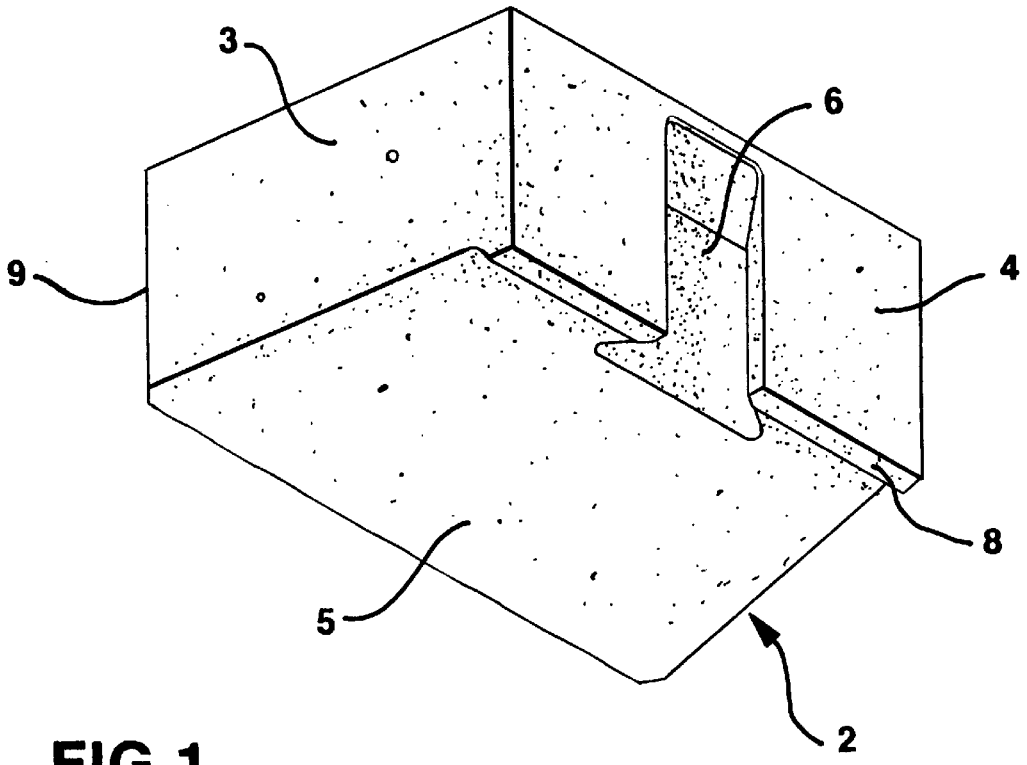
FIG. 1 is a perspective view showing the rear face, bottom and side of a preferred embodiment of the wall block according to the present invention.
Figure 3:
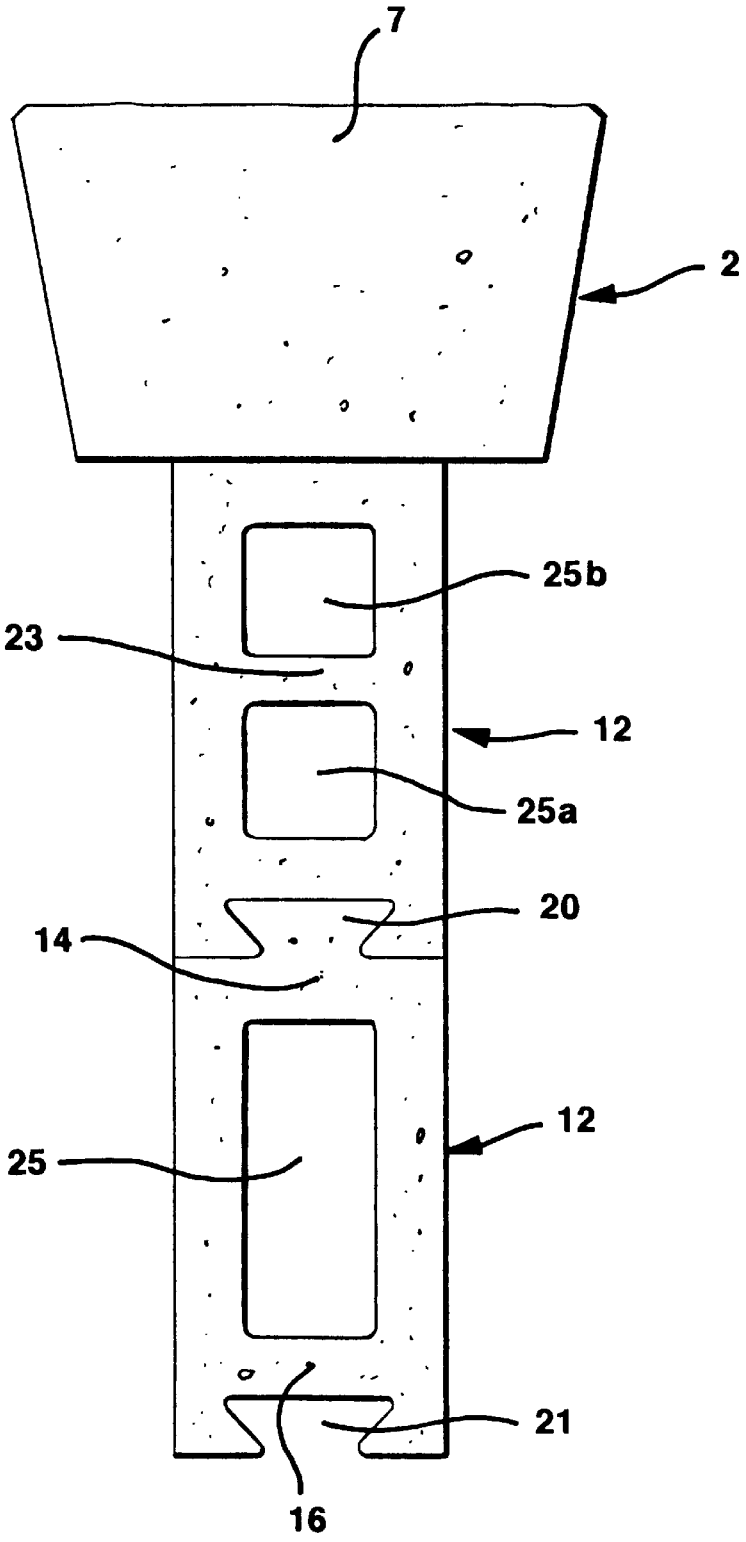
FIG. 3 is a top plan view showing preferred embodiments of anchor blocks according to the present invention attached to each other and to a wall block.
Figure 4:
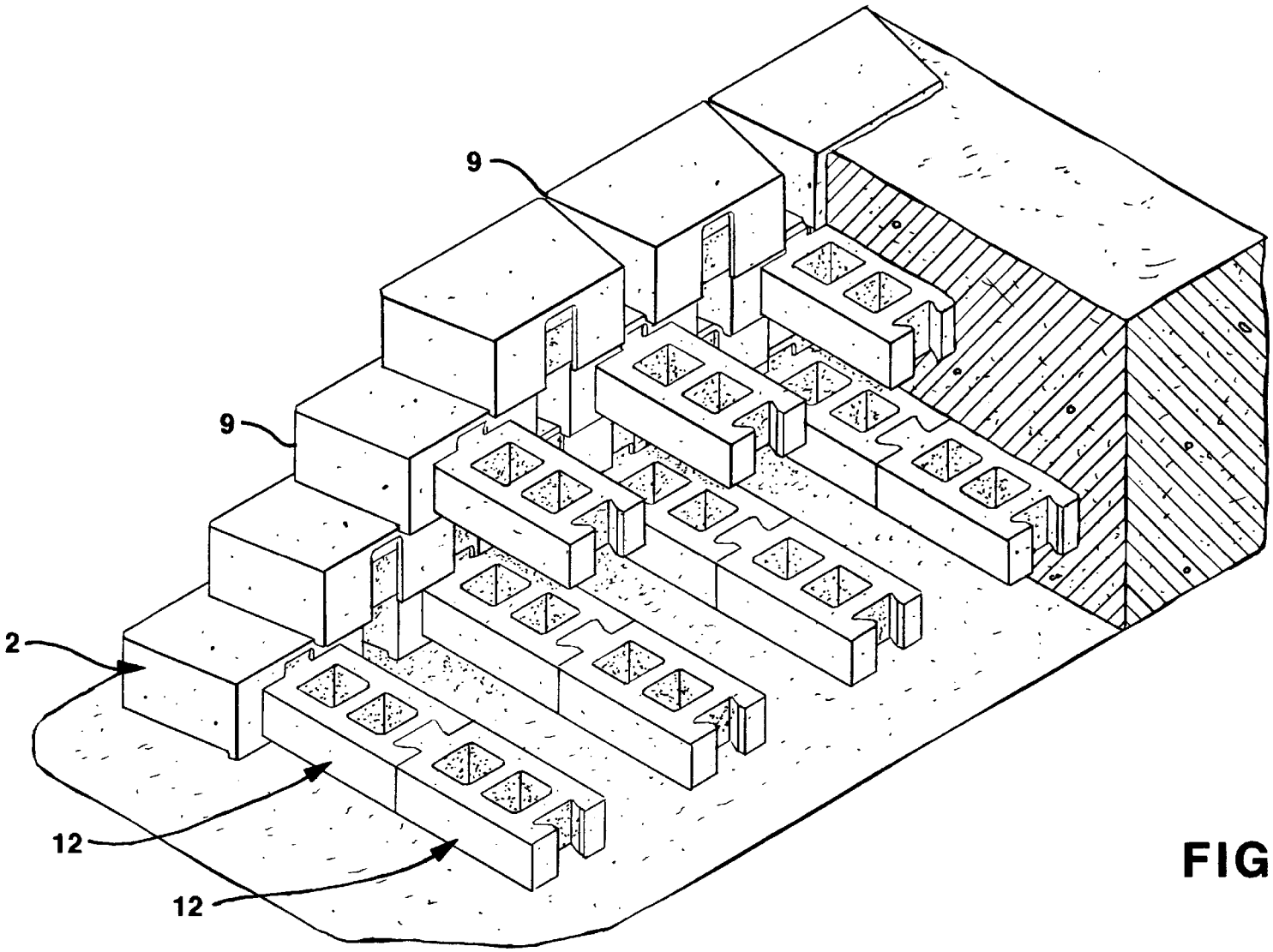
FIG. 4 is a cutaway view showing a portion of a retaining wall constructed according to the present invention.

FIG. 1 is a perspective view of a preferred embodiment of a wall block 2 according to the present invention. The wall block is a solid, composite, masonry block which may be cast in a commercially available block forming machine and conditioned in a heated kiln in a manner well known to those skilled in the art of fabricating composite masonry blocks. The wall block illustrated in FIG. 1 and FIG. 3 is generally shaped as a trapezoidal solid. The wall block 2 has a decorative front face, not illustrated in the drawings, and a rear face 4 which is generally parallel to the front face. The wall block has a top surface 7 which is generally parallel to a bottom surface 5. A key way 6 is formed in the rear face of the wall block. A ledge 8 extends downwardly from the bottom surface 5 and across the rear face 4.

Figure 2:
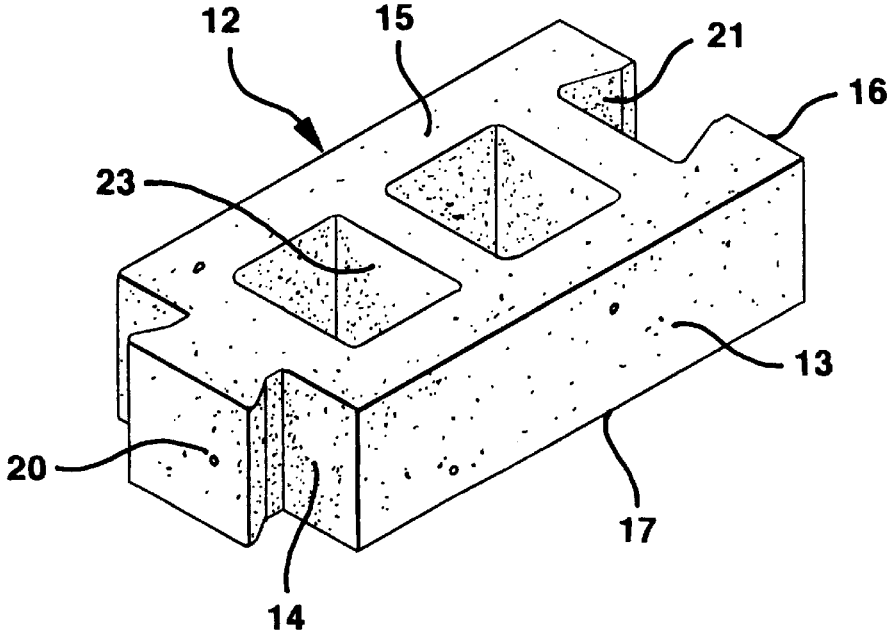
FIG. 2 is a perspective view showing a preferred embodiment of the anchor block according to the present invention.

FIG. 2 is a perspective view of a preferred embodiment of an anchor block 12, the second block in the set of blocks according to the present invention. FIG. 3 also shows preferred embodiments of the anchor block. The anchor block comprises a first end plate 14, a second end plate 16 which is generally parallel to the first end plate and two side plates 13 which are generally parallel to each other and generally perpendicular to the first end plate and the second end plate. A central passage 25, defined by the side plates, the first end plate and the second end plate, extends through the anchor block from a top surface 15 to a bottom surface 17 of the anchor block and is shown in the preferred embodiment of the anchor block as illustrated in FIG. 3 which is more distant from the wall block 2. In the preferred embodiment illustrated in FIG. 2, and in FIG. 3, a central plate 23 extends between the side plates and thus two apertures, 25*a* and 25*b* are defined by the central plate, the end plates and the side plates. Those skilled in the art will recognize that the central plate strengthens the anchor block. A key 20 extends outwardly from the first end plate. This key is complementary in size and shape to the key way 6 which is formed in the rear face 4 of the wall block. A key slot 21, complementary in size and shape to the key 20, is formed in the second end plate. The anchor block may be molded in commercially available block forming machines and cured in a heated kiln in a manner well known to those of ordinary skill in the art.

A retaining wall of predetermined length, shape and height may be constructed from a plurality of wall blocks and anchor blocks described above according to the following method. First, the terrain is prepared to receive the first course of wall blocks. Next the wall blocks are laid so that the vertical edges 9 defined by the decorative front face 4 and a side face 3 of each block are adjacent to a corresponding vertical edge 9 of an adjacent block and the decorative front faces are exposed on the same side of the retaining wall under construction. Because the side faces are not parallel, the wall blocks may be rotated to cause the first course to follow a predetermined path.

Then the key of an anchor block is inserted into the key way of each wall block and the key of a second anchor block is inserted into the key slot of the first anchor block. This creates an anchor which extends rearward from the wall block. Normally two anchor blocks will be sufficient for the first course. However, at sites where the characteristics of the soil, the climate to which the retaining wall will be exposed and other conditions dictate, a third anchor block may be added.

Next a second course of wall blocks is laid. Each wall block in the second course is placed on the first course of wall blocks in such a manner that its spacing and locking ledge 8 engages the rear faces of two adjacent blocks in the first course. After the second course of wall blocks has been completed, the space behind the retaining wall is back filled with soil, gravel and other suitable material. Because of the physical engagement of the locking ledge and the adjacent wall blocks in the course below, the wall blocks in the second course are stabilized and held in place by the wall blocks of the first course and the anchor courses. Accordingly, in almost every application, it will not be necessary to lay anchor courses to stabilize the wall blocks in the second course of wall blocks.

The foregoing steps are repeated until the retaining wall reaches the predetermined height. The topmost course will not require the use of anchor blocks. Further, while the lower pairs of courses may require two or more anchor blocks for each wall block in the first course of the pair, the higher courses will require only one anchor block for each wall block in the first course of the pair.

The set of blocks according to the present invention provides several important advantages due to the unique combination of features embodied in the blocks. First, the trapezoidal shape of the wall blocks provides a space between the sides of adjacent blocks which provides a path for ground water to flow through the retaining wall. This provides natural drainage of the soil being held in place by the retaining wall and prevents hydrostatic pressure from building up behind the retaining wall.

Second, the ledge on the bottom rear of the wall blocks causes the retaining wall to be inclined rearward, away from the face of the retaining wall. The resulting incline improves the holding power and stability of the retaining wall. The resulting incline also improves the appearance of the retaining wall. Sunlight falling on a vertical wall will cast shadows wherever a higher block extends outwardly from the face of the wall with respect to a neighboring lower block, thus calling attention to even slight imperfections in vertical walls. Sunlight falling on an inclined retaining wall built according to the present invention will not result in higher blocks casting shadows on their lower neighbors.

Third, the central passage in the anchor blocks enables the anchor blocks to be made small and light in weight in comparison to the wall blocks. The anchor blocks achieve their holding power not through their weight, but through the soil back filled into the central passage and then compacted. This soil provides resistance to any forces which tend to displace the anchor block.

Fourth, the height and weight of the anchor blocks make the process of laying the blocks to build a retaining wall a more efficient and safer process. When the lower course in a pair of courses is laid, a wall block is placed in position. The mason then may grasp the top of the wall block key way with one hand and the central plate of an anchor block with the other hand. The mason then pivots the rear of the wall block upwardly and aligns the key of the anchor block with the key way and lowers the rear of the wall block. Thus the mason is able to attach the anchor block to the wall block without lifting the full weight of the wall block. This substantially reduces the chance of lower back injury to the mason. Because the anchor block key is substantially shorter than the height of the wall block key way, the mason does not have to worry about having his fingers pinched between the key and the key way. When the anchor block and the wall block are aligned and in place, the weight of the wall block is sufficient to hold the anchor block in place suspended slightly above the soil. This means that the back filling step need not include leveling the back fill to provide alignment and support for the anchor blocks.

Fifth, the ledge on the wall blocks makes it possible to construct a retaining wall by attaching anchor blocks only to wall blocks in alternate courses. Forces generated by the soil being retained by the wall must either force the unanchored wall block forward or cause the unanchored wall block to rotate. Thus the wall blocks not attached to anchor blocks are held in place by the combination of the action of the ledge on the wall blocks in the adjacent lower course, the weight of the wall blocks in all higher courses and action of the anchor blocks attached to the wall blocks in the course above and the course below.

Having thus described our invention, many modifications and variations thereto will become apparent to those skilled in the art to which the invention pertains, which may be made without departing from the spirit and scope of the present invention. Therefore, we claim as our invention not only the embodiments described above and illustrated in the drawings, but all such modifications, variations and equivalents thereof as come within the spirit and scope of the following claims.

What is claimed is:

1. A set of composite, masonry blocks for use in constructing a retaining wall, the set of blocks comprising:

a wall block, generally in the shape of a trapezoidal solid, having a decorative front face, a rear face opposite and generally parallel to the front face, a top surface which is generally perpendicular to both the front face and the rear face, a bottom surface opposite and parallel to the top surface, and two side faces;

a ledge having first and second collinear, non-contiguous ledge portions extending downwardly from the bottom surface and across the rear face of the wall block;

further, the rear face of the wall block defining a key way, wherein the key way includes an aperture in the bottom surface of the wall block and a corresponding aperture in the rear face of the wall block, the apertures forming the key way being positioned between said first and second ledge portions;

an anchor block, in the shape of a rectangular solid, having a first end plate, a second end plate which is opposite to and generally parallel to the first end plate, two generally parallel side plates which extend between, and are generally perpendicular to, the end plates;

a central passage, defined by the end plates and the side plates, extending through the anchor block;

a key, complementary in size and shape to the key way in the wall block, extending outwardly from the first end plate, for cooperative engagement with the key way apertures of the wall block; and further the second end plate defining a key slot which is complementary in size and shape to the key.

2. The set of composite, masonry blocks according to claim 1, wherein the anchor block further comprises:

a central plate, located between the first end plate and the second end plate, parallel to the first end plate and the second end plate, and extending between, and perpendicular to, the side plates.

3. The set of composite, masonry blocks according to claim 1, wherein the height of the anchor block is substantially shorter than the height of the wall block.

4. The set of composite, masonry blocks according to claim 1, wherein the height of the anchor block is not less than one-third the height of the wall block nor more than three-fourths the height of the wall block.

5. The set of composite, masonry blocks according to claim 1, wherein the height of the anchor block is substantially shorter than the height of the wall block and the height of the wall block key way exceeds the height of the anchor block key.

6. The set of composite, masonry blocks according to claim 2, wherein the height of the anchor block is substantially shorter than the height of the wall block and the height of the wall block key way exceeds the height of the anchor block key.

* * * * *